US010584397B2

(12) United States Patent
Schulz

(10) Patent No.: US 10,584,397 B2
(45) Date of Patent: Mar. 10, 2020

(54) DEVICE AND METHOD FOR THE PRODUCTION OF A METALLIC STRIP

(71) Applicant: Vacuumschmelze GmbH & Co. KG, Hanau (DE)

(72) Inventor: Robert Schulz, Frankfurt am Main (DE)

(73) Assignee: VACUUMSCHMELZE GMBH & CO KG, Hanau (DE)

( * ) Notice: Subject to any disclaimer, the term of this patent is extended or adjusted under 35 U.S.C. 154(b) by 185 days.

(21) Appl. No.: 15/591,604

(22) Filed: May 10, 2017

(65) Prior Publication Data

US 2017/0240993 A1 Aug. 24, 2017

Related U.S. Application Data

(62) Division of application No. 13/182,013, filed on Jul. 13, 2011, now Pat. No. 9,700,937.

(30) Foreign Application Priority Data

Jul. 14, 2010 (DE) ..... 10 2010 036 401

(51) Int. Cl.

| | |
|---|---|
| ***B22D 11/00*** | (2006.01) |
| ***B22D 11/06*** | (2006.01) |
| ***B22D 11/112*** | (2006.01) |
| ***C21D 9/52*** | (2006.01) |
| ***C22C 38/00*** | (2006.01) |
| ***C21D 8/02*** | (2006.01) |
| ***C22C 45/02*** | (2006.01) |

(52) U.S. Cl.

CPC ..... *C21D 9/52* (2013.01); *B22D 11/001* (2013.01); *B22D 11/0611* (2013.01); *B22D 11/0682* (2013.01); *B22D 11/112* (2013.01); *C21D 8/0205* (2013.01); *C22C 38/00* (2013.01); *C22C 45/02* (2013.01); *C21D 2201/03* (2013.01); *C22C 2200/02* (2013.01); *C22C 2200/04* (2013.01); *Y10T 428/12993* (2015.01); *Y10T 428/24355* (2015.01)

(58) Field of Classification Search

CPC ..... B22D 11/00; B22D 11/001; B22D 11/06; B22D 11/0611; B22D 11/0682; B22D 11/112

USPC ..... 164/463, 479, 423, 429, 158

See application file for complete search history.

(56) References Cited

U.S. PATENT DOCUMENTS

| | | | | |
|---|---|---|---|---|
| 4,793,400 | A | 12/1988 | Wood | |
| 6,749,700 | B2 * | 6/2004 | Sunakawa et al. | C22C 33/003 148/561 |
| 9,700,937 | B2 * | 7/2017 | Schulz | B22D 11/0611 |

* cited by examiner

*Primary Examiner* — Kevin P Kerns

(74) *Attorney, Agent, or Firm* — Dickinson Wright PLLC

(57) ABSTRACT

A device for the production of a metallic strip using a rapid solidification technology is specified, which device includes a movable heat sink with an external surface onto which a melt is poured and on which the melt solidifies to produce the strip, and which device includes a rolling device which can be pressed against the external surface of the movable heat sink while the heat sink is in motion.

9 Claims, 13 Drawing Sheets

DEVICE AND METHOD FOR THE PRODUCTION OF A METALLIC STRIP

CROSS-REFERENCE TO PRIOR APPLICATIONS

This patent application is a divisional of U.S. patent application Ser. No. 13/182,013, filed on Jul. 13, 2011, which is now U.S. Pat. No. 9,700,937, and which claims priority to German Application No. DE 10 2010 036 401.0, filed on Jul. 14, 2010. The entire disclosure of each of the above applications is incorporated herein by reference.

BACKGROUND

1. Field

Disclosed herein is a device and to a method for the production of a metallic strip, in particular using a rapid solidification technology.

2. Description of Related Art

In a rapid solidification technology, a melt is poured onto a fast-moving heat sink, and the melt solidifies on the heat sink owing to the thermal conductivity of the latter. If the melt is continuously poured onto the moving heat sink, a strip is produced.

U.S. Pat. No. 4,793,400 discloses a device of this type for the production of a metallic strip. The device comprises two rotatable brushes which are used for cleaning the surface of the heat sink before the melt is applied to the heat sink. These brushes are used for removing dust, rubble and melt residues from the surface. The aim of this arrangement was to produce very few faults in the rapidly solidified strip and to produce a more homogeneous strip. The device further comprises a vacuum source which picks up the removed objects, ensuring that they are removed reliably and not returned to the surface.

Further improvements are, however, desirable if the quality of the strip, for example its homogeneity, is to be improved.

SUMMARY

An embodiment disclosed herein provides a device for the production of a metallic strip by means of a rapid solidification technology, which device comprises a movable heat sink with an external surface and a rolling device. A melt is poured onto the external surface and there solidifies while a strip is produced. The rolling device can be pressed against the external surface of the movable heat sink while the heat sink is in motion.

In embodiments of the device disclosed herein, the external surface is therefore contacted by the rolling device while the heat sink is in motion. The rolling device is used for repeatedly preparing the external surface before the melt solidifies thereon. The external surface can be roller-burnished with the rolling device and therefore worked, so that the external surface is smoothed. In this context, the term "work" should be understood to mean a redistribution of material. The removal of material from the external surface, which can be achieved by means of a brush, is not an object of the use of the rolling device. No chips are produced, and there is hardly any debris or dust which could have a negative effect on the production process.

The pressure required for working the external surface depends on the material and the condition of the heat sink or of the external surface of the heat sink. A lower pressure is used for a soft material such as copper than for a hard material such as steel.

The rolling device is in particular pressed against a point of the external surface of the movable heat sink which lies between the point where the strip separates from the heat sink and the pouring surface, i.e. the point of the heat sink where the melt hits the heat sink. The external surface can therefore be worked by means of the rolling device after the strip has solidified thereon and before the next contact with the melt.

In one embodiment, the rolling device is pressed against the external surface of the movable heat sink in such a way that the external surface is smoothed by the rolling device. As a result, the external surface is less rough after the contact with or the working by the rolling device than before the contact with the rolling device. This has the advantage that the roughness of the strip and in particular the roughness of the surface of the strip, which is generated by the solidification of the strip on the external surface of the movable heat sink, can be kept low. As a result, the homogeneity of the strip is ensured over longer sections.

This allows for a longer casting process and reduces production costs. In addition, a low roughness can improve various properties of the strip which is produced. The surface roughness of some magnetic alloys, for example, affects their magnetic properties. By producing a long strip with a homogeneous and low surface roughness, several magnet cores having homogeneous properties can be produced in one casting process. This reduces manufacturing costs, because there are fewer losses.

In one embodiment, the rolling device is designed such that that it continuously contacts the external surface of the movable heat sink while the melt is poured onto the external surface of the movable heat sink. In this arrangement, the surface on which the melt solidifies can be worked before it once again meets the melt. This results in a more homogeneous external surface and therefore in rapidly solidified strips.

In another embodiment, the rolling device is designed such that that it reduces the roughness of the external surface of the movable heat sink by working the external surface while the melt is poured onto the external surface of the movable heat sink. The working of the external surface therefore results in a reduced surface roughness.

In one embodiment, the movable heat sink is rotatable about an axis of rotation, i.e. the movement is a rotation. In order to achieve a desired cooling rate and a desired strip thickness, the peripheral speed of the heat sink is set accordingly. As the peripheral speed increases, the strip thickness is reduced more and more. A typical cooling rate is more than $10^5$ K/s. The peripheral speed may be 10 m/s to 50 m/s.

The heat sink may have the shape of a wheel or a roller, the melt being applied to the peripheral surface of the wheel or roller respectively. The axis of rotation is therefore perpendicular to the centre of the circular end of the wheel.

In one embodiment, the rolling device is movable parallel to the axis of rotation of the movable heat sink. In this arrangement, the rolling device can be brought into contact with different regions of the width of the heat sink, for example with only a part of the peripheral surface of the wheel. This can be advantageous if there are several casting tracks on a heat sink. One casting track can be worked by the rolling device after another casting track, so that several casts can be made with one and the same heat sink but with different casting tracks, without having to exchange the heat sink. This may reduce production times and therefore production costs.

The rolling device may alternatively be movable at right angles to the external surface of the movable heat sink. If the external surface moves in the z-direction, the rolling device may be movable in the x-direction and/or in the y-direction. Movement in the x-direction may for example allow different strip-shaped regions of the external surface to be worked. Movement in the y-direction can be used for adjusting the pressure with which the rolling device can be pressed against the external surface.

In one embodiment, the rolling device comprises a roller which can be rotatably pressed onto the external surface of the movable heat sink. The roller of the rolling device therefore contacts the external surface of the movable heat sink in order to prepare the said external surface repeatedly. The rolling device will further comprise a holder for the roller, so that the roller is rotatably mounted and movable with respect to the external surface, for example parallel to the axis of rotation of the movable heat sink and/or parallel to the external surface of the movable heat sink.

In one embodiment, the rolling device can be pressed onto the external surface of the movable heat sink with a profiled or spherical roller having a diameter of less than 100 mm and with a contact force up to 1000 N. The contact force or surface pressure is typically less than the yield strength of the heat sink material to avoid a macroscopic, i.e. large-surface, displacement or deformation of the material. As stated above, the pressure which results in an adequate working of the external surface is determined by the material of the external surface as well as by the geometry of the rolling device or roller.

In one embodiment, the roller is provided with a separate control for setting the speed of the roller. In this way, the speed of the roller of the rolling device can be adjusted independently of the speed of the heat sink.

In a further embodiment, the device is designed such that the roller of the rolling device can be pressed against the external surface of the movable heat sink, so that it is driven by the movement of the heat sink. In this case, the roller does not have its own drive. The surface of the rotating roller is however pressed against the external surface of the rotating heat sink with a pressure which ensures that it works the external surface of the heat sink.

In one embodiment, the roller of the rolling device has a first direction of rotation and the heat sink has a second direction of rotation, the first direction of rotation being opposed to the second direction of rotation. With this arrangement, the external surface of the movable heat sink is prepared in a rolling or roller-burnishing process.

In one embodiment, the roller of the rolling device is movable across the external surface parallel to the second axis of rotation of the heat sink. With a movement in a direction which is parallel to the second axis of rotation, the external surface can be contacted and worked spirally. This offers the advantage that the external surface is not bent, so that the thickness of the strip remains the same across its width.

In one embodiment, the device is further provided with a container for the melt to be poured. This container may be the container of a nozzle located immediately adjacent to the external surface, so that an opening from which the melt to be poured flows is arranged at a small distance from the external surface.

The container or the device respectively may further comprise heating means to melt the melt material and/or to keep it in the molten state.

The device may further comprise a receiving device for receiving the solidified strip. This receiving device may for example be a reel.

A method for the production of a strip using a rapid solidification technology is also specified. A melt and a movable heat sink with an external surface are provided. The melt is poured onto the moving external surface of the moving heat sink and solidifies on the external surface while forming a strip. A rolling device is pressed against the external surface of the heat sink while the heat sink is in motion.

The method is based on a rapid solidification technology in which the melt of a metal or alloy rapidly solidifies on contacting the external surface of the heat sink, while the heat sink and thus the external surface move fast. The melt is poured onto the external surface in a stream, so that a long strip is formed from the solidified metal or alloy owing to the movement of the heat sink.

The external surface of the heat sink is roller-burnished by means of the rolling device while the heat sink and thus the external surface are in motion. This roller-burnishing can be carried out such that the external surface is worked while being smoothed.

Roughness and irregularities in the external surface can be produced by the contact between the melt and the external surface. As the external surface repeatedly comes into contact with the melt, its quality is increasingly reduced as casting time increases.

These irregularities can be smoothed with the rolling device, so that a smooth external surface is once again brought under the melt. As a result, the surface roughness of the bottom surface of the strip, which is formed as the melt solidifies on the external surface, can be kept more homogeneous over the length of the strip.

In one embodiment, the rolling device is pressed against the external surface of the heat sink, so that it continuously contacts and works the external surface while the melt is poured onto the external surface of the heat sink. In this way, the surface on which the melt solidifies can be worked or smoothed.

Owing to the working of the external surface, the roughness of the external surface is reduced after the contact with the rolling device compared to the roughness of the external surface before the contact with the rolling device. The rolling device is pressed against the moving external surface of the moving heat sink before the melt is poured onto the external surface. The rolling device is therefore placed downstream of the point where the melt hits the external contact surface. This enhances the uniformity of the external surface as well as of the underside of the rapidly solidified strip.

In one embodiment, the rolling device comprises a rotatably mounted roller.

The heat sink may be provided in the form of a rotatable wheel, the melt being poured onto the rim of the wheel. The roller of the rolling device may be arranged such that, together with the rim, it forms a rolling mill which works and smoothes the surface of the rim.

If a rotatable roller is provided as a rolling device, this roller can be driven in a first direction of rotation, while the heat sink is driven in a second direction of rotation, the first direction of rotation being opposed to the second direction of rotation. Owing to the friction between the roller and the heat sink, the heat sink may drive the roller. This results in two opposed directions of rotation. As an alternative, the roller may be driven independently under its own control, and the device may include a separate control for setting the speed of the rotatable roller.

In one embodiment, the roller is moved over the external surface parallel to the second axis of rotation of the heat sink while the heat sink is in motion, so that the external surface is contacted and worked spirally. This embodiment can be used in order to reduce irregularities across the overall width of the external surface.

As an alternative, the roller may be moved parallel to the second axis of rotation of the heat sink, enabling it to contact a wider region of the external surface. This method can be used if the heat sink is designed such that two or more casting tracks are provided on the external surface.

After the strip has been produced by rapid solidification on the external surface of the heat sink, it separates from the external surface owing to the shrinkage of the solidified melt and the movement of the external surface. This strip can be taken up continuously on a reel in order to avoid cracks and kinks in the strip.

A metallic strip having a length of at least 30 km is specified as well. This strip has at least one surface with a surface roughness $R_a$ of $0<R_a<0.6$ mm at a point at least 20 km before an end of the strip, $R_a$ being the centre-line average height.

In further embodiments, the lowest possible surface roughness is not the object of the invention. For a good strip quality, the surface roughness, which can be adjusted by means of the contact pressure of the rolling device, is held nearly constant over a long production process. Over a length of at least 20 km, the surface roughness can be held within a range of $0.2<R_a<0.6$ mm+/−0.2 mm, preferably +/−0.15 mm.

This strip be produced with the device and the method disclosed herein, so that this low surface roughness can be obtained after a long casting time and therefore at a point which lies at least 20 km away from the end of the strip, in particular from the beginning of the strip.

In one embodiment, the metallic strip is ductile and amorphous or ductile and nanocrystalline. The crystallisation or the degree of crystallisation of the strip can be set by means of the cooling rate and/or the composition of the strip.

The metallic strip may have numerous different compositions, for example $T_aM_b$, wherein 70 atomic % £ a £85 atomic % and 15 atomic % £ b £30 atomic %, T being one or more transition metals, such as Fe, Co, Ni, Mn, Cu, Nb, Mo, Cr, Zn, Sn and Zr, and M being one or more metalloids, such as B, Si, C and P.

Nanocrystalline strip may consist of $Fe_aCu_bM_cM'_dM''_eSi_fB_g$, M being one or more of the elements from the group of the IVa, Va, VIa elements or the transition metals, M' being one or more of the elements Mn, Al, Ge and the platinum group elements, and M" being Co and/or Ni, wherein a+b+c+d+e+f+g=100 atomic and 0.01£ b £8, 0.01£c £10, 0£ d£10, 0£ e £20, 10£ f £25, 3£ g £12 and 17 £f+g £30.

The device may be used for the production of a metallic strip from $T_aM_b$, wherein 70 atomic % £ a £85 atomic % and 15 atomic % £ b £30 atomic %, T being one or more transition metals, such as Fe, Co, Ni, Mn, Cu, Nb, Mo, Cr, Zn, Sn and Zr, and M being one or more metalloids, such as B, Si, C and P, or from $Fe_aCu_bM_cM'_dM''_eSi_fB_g$, M being one or more of the elements from the group of the IVa, Va, VIa elements or the transition metals, M' being one or more of the elements Mn, Al, Ge and the platinum group elements, and M" being Co and/or Ni, wherein a+b+c+d+e+f+g=100 atomic % and 0.01£ b £8, 0.01£c £10, 0£ d£10, 0£ e £20, 10£ f £25, 3£ g £12 and 17 £f+g £30.

BRIEF DESCRIPTION OF THE DRAWINGS

Embodiments are explained in greater detail below with reference to the drawings.

DETAILED DESCRIPTION OF SPECIFIC EMBODIMENTS

Figure 1:
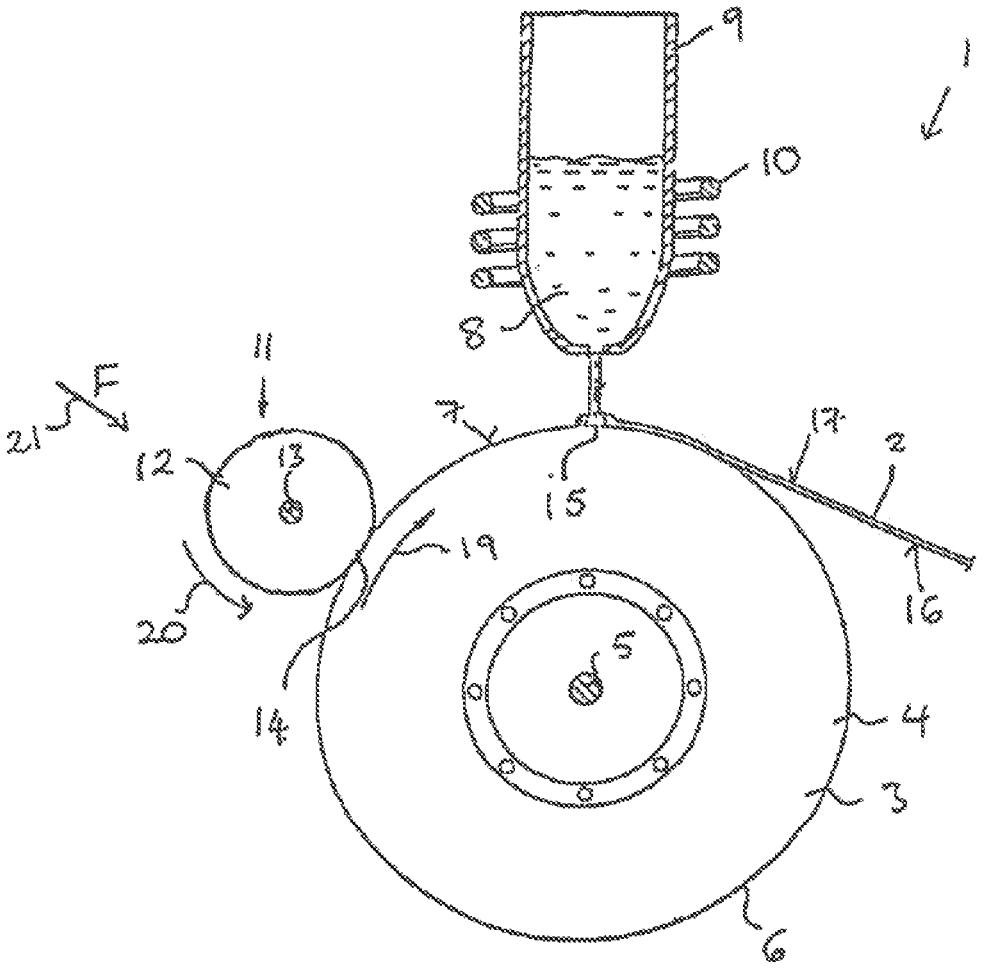
FIG. 1 is a first diagrammatic view of an embodiment of a device with a rolling device for the production of a metallic strip using a rapid solidification technology.
Figure 2:
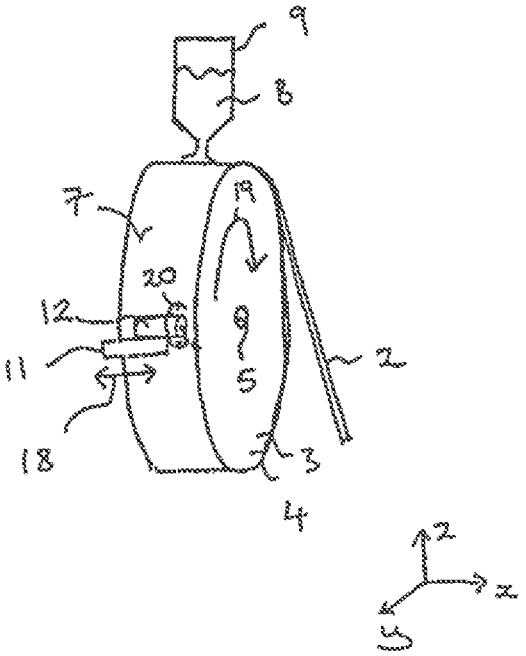
FIG. 2 is a second diagrammatic view of the device from FIG. 1.
Figure 3:
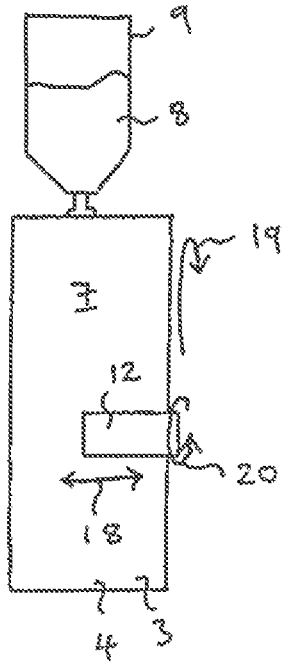
FIG. 3 is a third diagrammatic view of the device from FIG. 1.

FIGS. 1 to 3 are various diagrammatic representations of a device 1 for the production of a metallic strip 2 using a rapid solidification technology.

The device 1 comprises a heat sink 3 in the form of a wheel 4 which rotates clockwise about an axis of rotation 5 as indicated by arrow 19. The wheel 4 has a rim 6 with an external surface 7 onto which a melt 8 is poured. The melt 8 consists of a metal or an alloy which is stored in a container 9. The embodiment of device 1 further comprises a heater (such as, e.g., an induction heater) for producing the melt 8 from the metal or alloy.

The device 1 further comprises a rolling device 11 with a roller 12. The roller 12 rotates on an axis of rotation 13 and is arranged such that it can be pressed against the external surface 7 of the rim 6 of the heat sink 3 under pressure as indicated by arrow 21. The roller 12 rotates anticlockwise and therefore in a direction opposed to the direction of rotation of the wheel 4 (i.e., where the roller 12 contacts external surface 7 of rotating wheel 4, the surfaces move in a parallel direction). Together with the rotating wheel 4, the roller 12 forms a rolling mill which is used to roller-burnish and thus smooth the external surface 7 of the rim during the casting process.

The roller 12 is so arranged on the wheel 4 that it works the external surface 7 at a point 14 which is upstream (with respect to the direction of rotation of wheel 4) of the point 15 where the melt 8 first contacts the external surface 7. The melt 8 is therefore poured onto a smooth external surface 7 and solidifies on this roller-burnished and smoothed surface. Owing to the rotating wheel 4 and the stream of melt 8, a long strip 2 is produced as the melt 8 solidifies. As a result of the volume shrinkage of the solidifying melt 8 and the rotating wheel 4, the strip 2 separates from the external surface 7 and can be wound onto a reel (not shown in the drawing).

The underside 16 of the strip 2 approximately adopts the contour of the external surface 7. The surface of the underside 16 of the strip 2 can be kept uniform if the roller 12 continuously works the external surface 7 during the casting process. This permits the production of a long strip 2 with a surface roughness which worsens only slightly from the beginning to the end. The top side 17 of the strip 2 solidifies freely and therefore does not reflect the contour of the external surface 7. In addition, cleaning brushes for removal of debris from the surface of heat sink 3 may also be included, or these may be absent.

As FIGS. 2 and 3 show, the roller 12 of the rolling device 11 may be moved in directions parallel to the axis of rotation 5 of the heat sink 3 as indicated by the arrow 18.

The roller 12 may be arranged such that it works different tracks on the rim. The roller 12 may be moved parallel to the axis of rotation of the heat sink while being in contact with the rotating heat sink 3. In this embodiment, the rim 6 or the external surface 7 can be worked and smoothed spirally.

Figure 4:
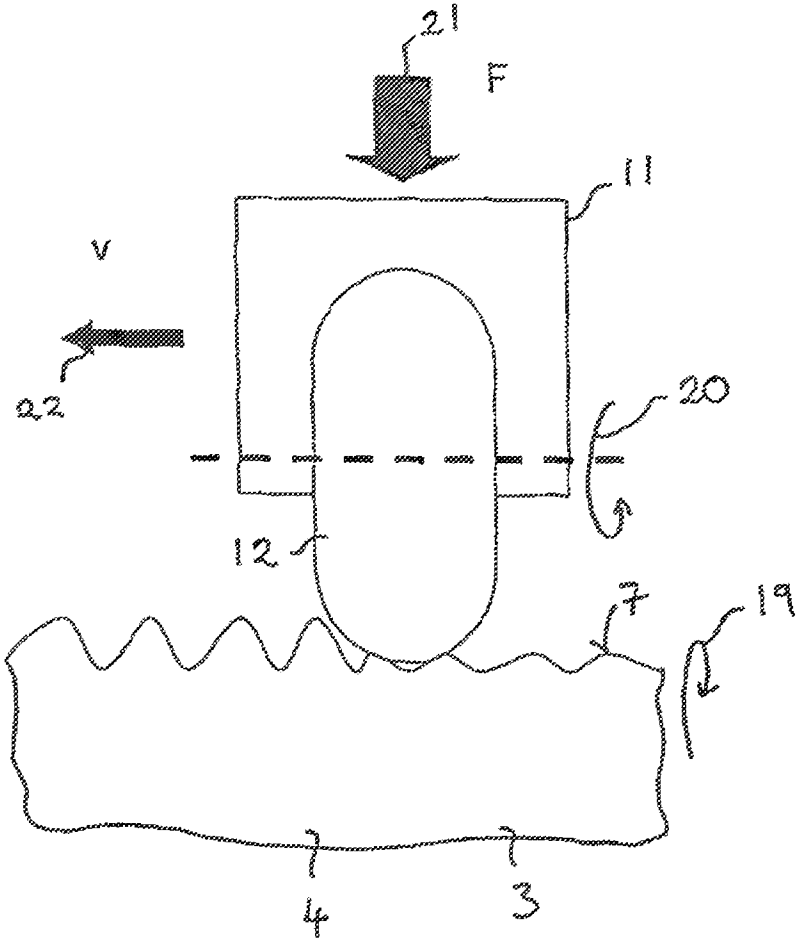
FIG. 4 is a detailed view of the rolling device from FIG. 1.

FIG. 4 is a diagrammatic representation of the working effect of the rolling device 11 with the roller 12 in contact with the external surface 7 of the heat sink 3.

The rotation of the heat sink 3 is in FIG. 4 illustrated graphically by the arrow 19, while the counter-rotation of the roller 12 is illustrated by the arrow 20. In the Figure, both arrows can be illustrated as rotating toward the viewer, out of the plane of the paper, or both rotating away from the viewer toward the plane of the paper. The pressure applied by the roller 12 on the external surface 7 is graphically illustrated by the arrow 21. In this embodiment, the roller is moved across the external surface parallel to the axis of rotation of heat sink 3. This is illustrated in FIG. 4 by the arrow 22.

On the left-hand side of the roller 12, the figure shows the external surface 7 of the heat sink after the strip has been formed on this external surface 7. On the right-hand side of the roller, we see the external surface after roller-burnishing with the roller 12, the roughness of the external surface 7 having been reduced by roller-burnishing. This method can also be used continuously during the casting and production of the strip. As a result, the melt 8 always meets a smooth external surface 7, so that the underside 16 of the solidified strip 2 has a smooth surface along its entire length.

To explain the effect of working a heat sink surface 7 during a casting process, an experiment is carried out which permits a direct comparison between a worked surface and a surface which has not been worked.

For these experiments, the alloy $Fe_RCu_1Nb_3Si_{15.5}B_7$, which is generally used for inductive cores, is chosen. In addition to a comparison of geometrical data, this permits the evaluation of magnetic properties using measuring cores. The chosen strip width is 25 mm, so that the strip did not have to be slit, for example by cutting, in order to produce the measuring cores.

To avoid the effects of unintentional parameter variations on the results, the whole experiment is carried out in one casting, i.e. all results are based on the same melt, the same heat sink including preparation and the same casting parameters. The only aspect which is changed is the position of the casting track.

To work the surface of the heat sink, a specific further development of "roller-burnishing" or "planishing" is chosen, which is adapted to the parameters of the casting process for rapidly solidified strip. The equipment comprises a resiliently mounted rolling head with a special roller, which moves parallel to the axis of the heat sink at a low feed rate. The working is carried out by the roller 12 which is pressed against the surface 7 of the heat sink 3 with a defined force as shown in FIG. 4.

In the first phase of the experiment, approximately 50 000 m of a 25 mm wide strip were poured onto a casting track which was worked continuously as described above.

In the next phase, another 50 000 m were to be poured onto a parallel track which had not been worked, in order to produce a strip for comparison. This process was, however, aborted after about 30 000 m for reasons of quality, as the state of the surface had deteriorated excessively.

The strips produced in this way were then evaluated and compared using geometrical and magnetic criteria. For the geometrical evaluation, the samples were left in the "as cast" state. For the evaluation of the magnetic properties, the wound cores were subjected to a heat treatment in order to obtain the magnetically relevant nanocrystalline material state.

The surface parameters $R_a$ and $R_z$ and the fill factor of the measuring cores were chosen as comparative variables, $R_a$ being the centre-line average height and $R_z$ being the averaged peak-to-valley height.

The surface parameters were determined on the side of the strip which faces the heat sink and largely reflect wear-related changes on the heat sink surface, while the fill factor is an essential quality criterion in magnetic cores.

Figure 5A:
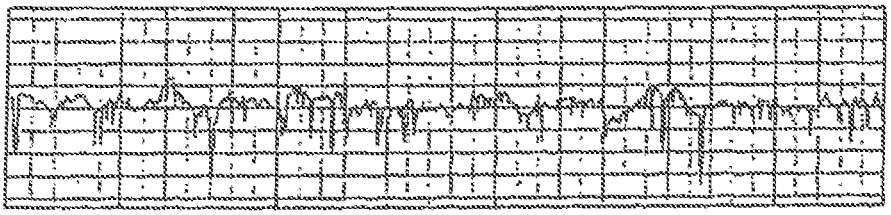
FIG. 5*a* shows the surface roughness of a strip underside facing the heat sink, as produced by means of the device from FIG. 1.

FIG. 5*a* illustrates the roughness values of the underside of the strip, i.e. the side facing the heat sink, of a casting track which has been worked after ca. 39 800 m.

Figure 5B:
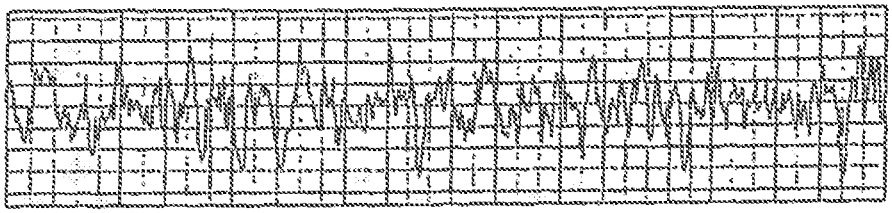
FIG. 5*b* shows the surface roughness of an underside of a comparative strip.

FIG. 5*b* illustrates the roughness values of the underside of the strip (facing the heat sink) of a comparison strip of a casting track which has not been worked after ca. 23 000 m.

The comparability of the investigated variables is at its best if, in addition to the casting parameters, the strip thickness is similar as well. This is because the fill factor change of the tested cores is greatly influenced by the relationship between roughness and strip thickness.

Figure 6:
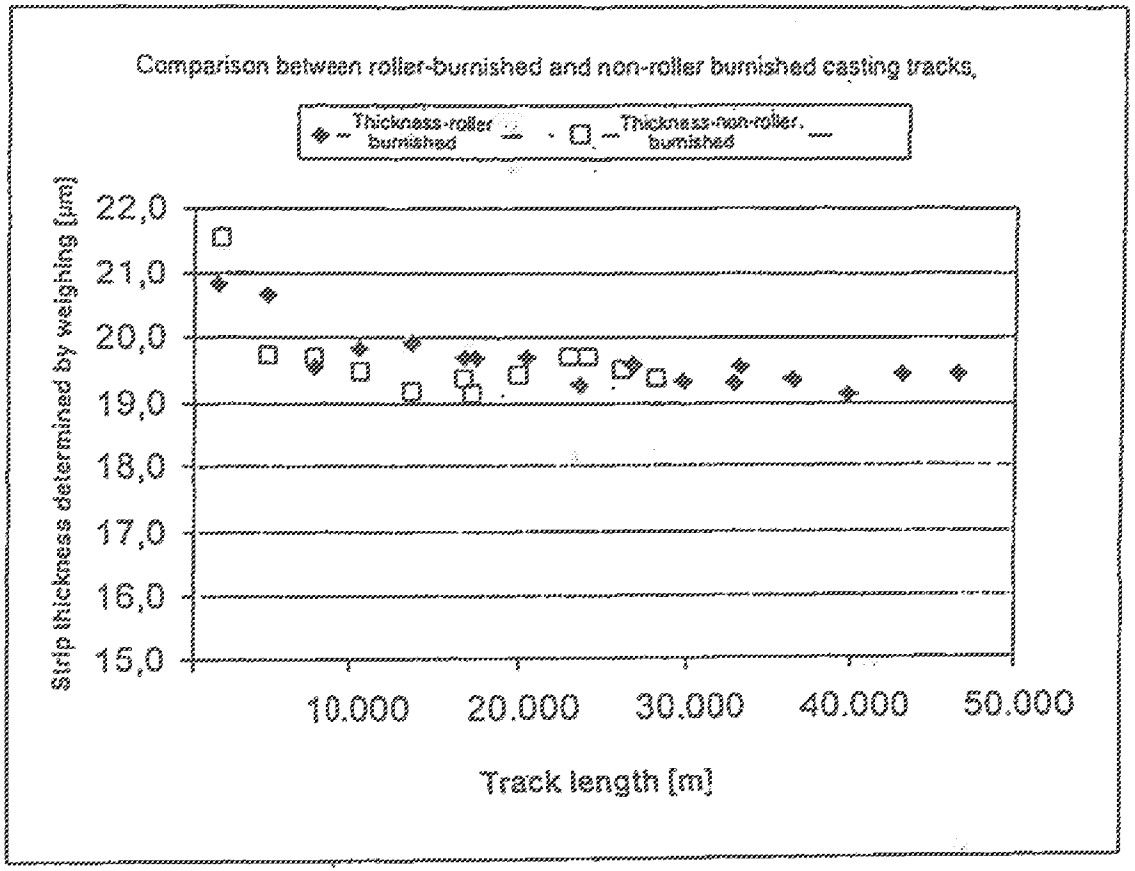
FIG. 6 is a graph showing the strip thicknesses as determined by weighing as a function of track length.

The strip thickness was determined by weighing in order to avoid errors caused by roughness in feeler measurements. Strip thickness values obtained by weighing are illustrated in the diagram of FIG. 6. FIG. 6 shows that the strip thickness values agree in both cases very well along the entire cast.

Figure 7:
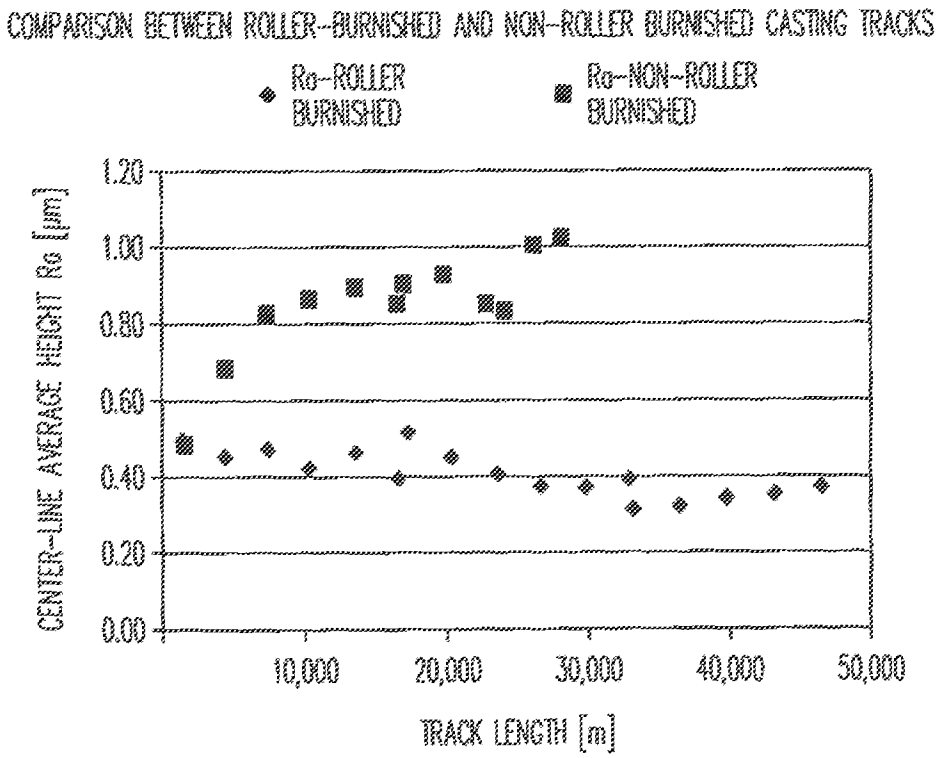
FIG. 7 is a graph showing a comparison of the surface parameter (centre-line average heights $R_a$) of the strip undersides for a strip produced on a casting track which has not been roller-burnished and for a strip produced on a casting track which has been roller-burnished as a function of track length.

FIG. 7 shows a comparison of the centre-line average heights $R_a$ of the strip undersides, approximately in the middle of the width of the strip, for a strip produced on a casting track which has not been roller-burnished and for a strip produced on a casting track which has been roller-burnished.

Figure 8:
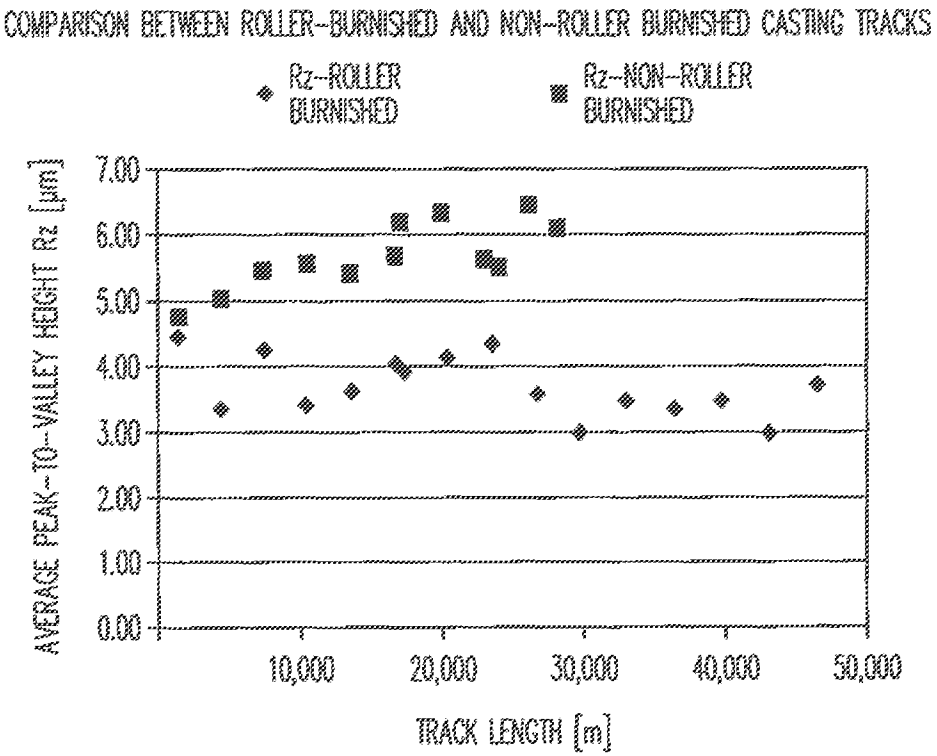
FIG. 8 is a graph showing a comparison of the surface parameter (peak-to-valley heights $R_z$) of the strip undersides for a strip produced on a casting track which has not been roller-burnished and for a strip produced on a casting track which has been roller-burnished as a function of track length.

FIG. 8 shows a comparison of the peak-to-valley height $R_z$ of the strip undersides, approximately in the middle of the width of the strip, for a strip produced on a casting track which has not been roller-burnished and for a strip produced on a casting track which has been roller-burnished.

In the diagrams of FIGS. 7 and 8, the development of the surface parameters $R_a$ and $R_z$ is plotted along the lengths of the worked and the non-worked casting track.

The comparison shows that the working of the heat sink surface can maintain and sometimes even improve the quality of the initial preparation over a very long casting process. In contrast, the surface of casting tracks which have not been worked deteriorates very rapidly.

Figure 9:
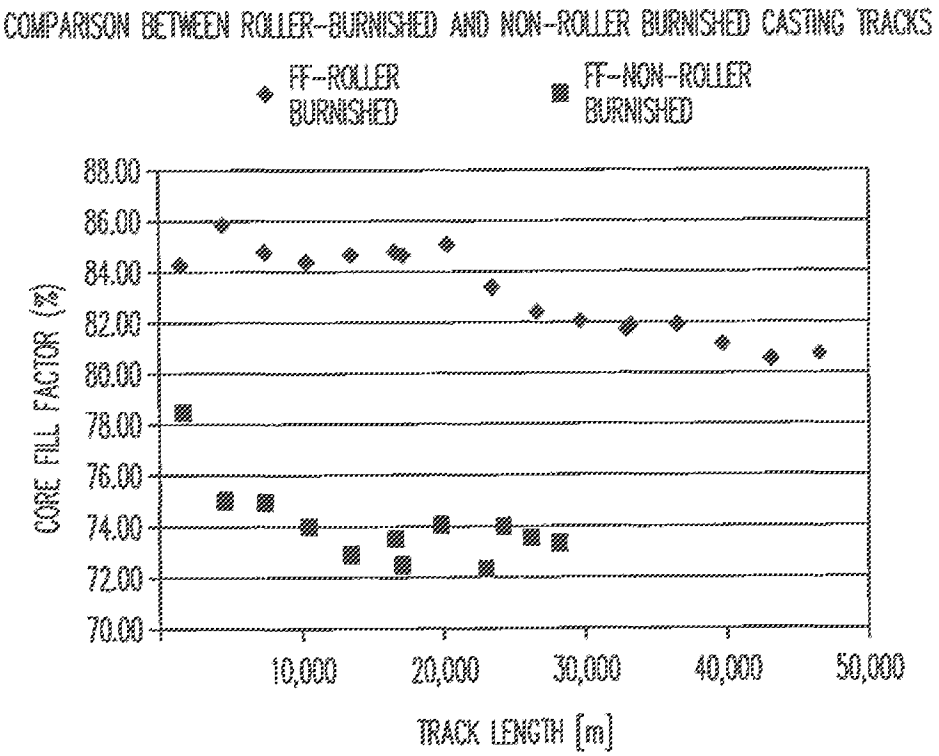
FIG. 9 is a graph comparing the fill factors of measuring cores wound from a strip produced on a casting track which has not been roller-burnished and from a strip produced on a casting track which has been roller-burnished as a function of track length.

Such differences are also found if we consider the fill factor of the measuring cores as a comparative variable. The diagram of FIG. 9 compares the fill factors of measuring cores (diameter 24.3/13×25 mm) wound from a strip produced on a casting track which has not been roller-burnished and from a strip produced on a casting track which has been roller-burnished.

The fill factors of the two groups noticeably drift away from each other after a relatively short run, illustrating that even small changes in the surface quality of the heat sink result in significant quality differences in the finished product.

The surface formation of the strips can affect their magnetic properties. It for example significantly affects the shape of the hysteresis loop and the remagnetisation processes in alternating fields.

The three characteristics $m_{sin}$ at H=15 mA/cm, $m_{dyn}$ at H=15 mA/cm and the $m_{dyn}/m_{sin}$ ratio are measured and evaluated. These values are mainly related to the requirements of current transformer cores for earth leakage circuit breakers at 50 Hz.

The aim is high permeability accompanied by a high ratio. Empirical data permit comparisons between different permeability values and ratios. The normalised value is $m_{80}$ (=$m_{dyn}$ at H=15 mA/cm and $m_{dyn}/m_{sin}$=0.8).

Figure 10:
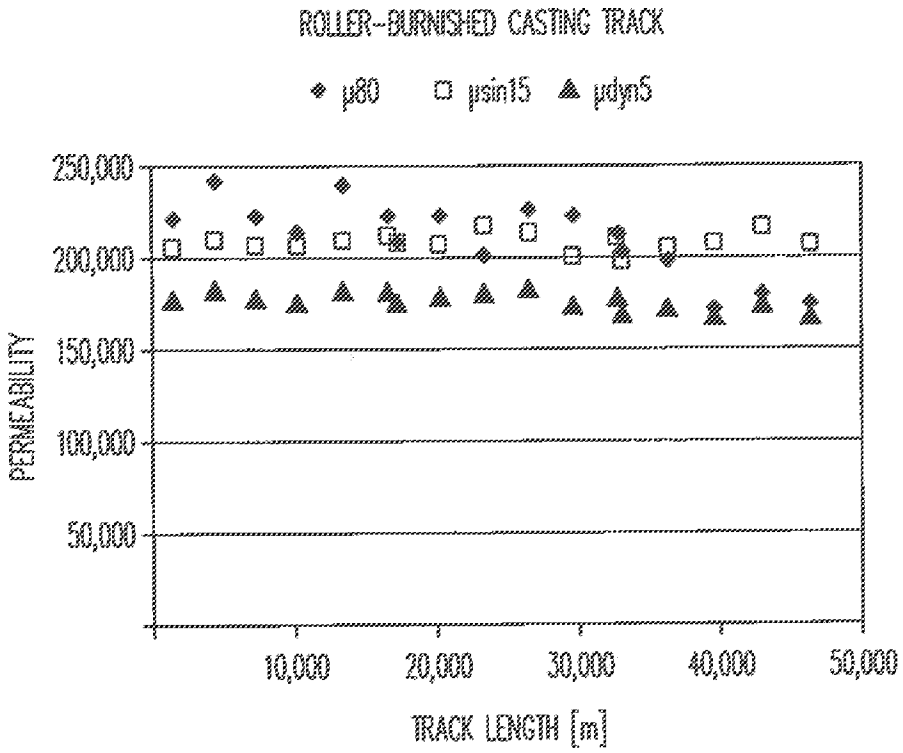
FIG. 10 is a graph that shows the development of the permeability of a strip produced on a continuously worked casting track as a function of track length.
Figure 11:
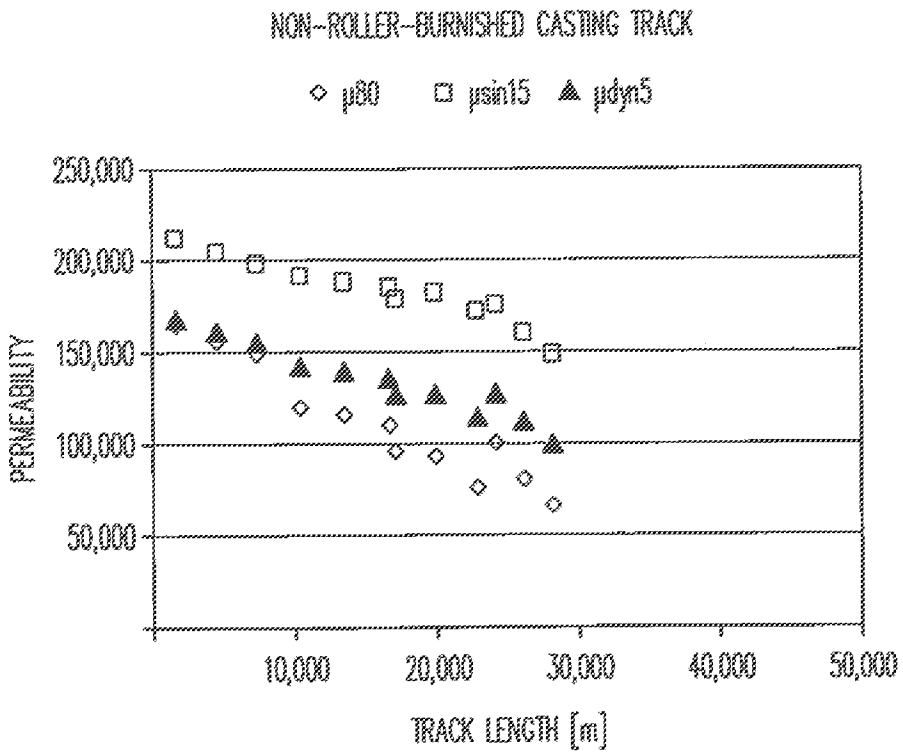
FIG. 11 is a graph that shows the development of the permeability of a strip produced on a casting track which is not continuously worked as a function of track length.

In the diagrams of FIGS. 10 and 11, the permeability developments are initially shown separately for worked and non-worked casting tracks. The permeability $m_{sin}$ should remain largely constant, because it is theoretically determined only by the alloy and the heat treatment.

FIG. 10 shows the development of the permeability of a strip produced on a continuously worked casting track. The permeability changes only slightly over a length of 50 000 m.

FIG. 11 shows the development of the permeability of a comparative strip produced on a casting track which has not been worked. In contrast to FIG. 10, $m_{sin}$ can be seen to have decreased considerably. This indicates significant disturbing influences after a relatively short track length.

As the permeability $m_{dyn}$ reacts even more strongly to changes than $m_{sin}$, the $m_{dyn}/m_{sin}$ ratio and the normalised $m_{80}$ decrease particularly strongly, which indicates a significant deterioration of linearity.

Figure 12:
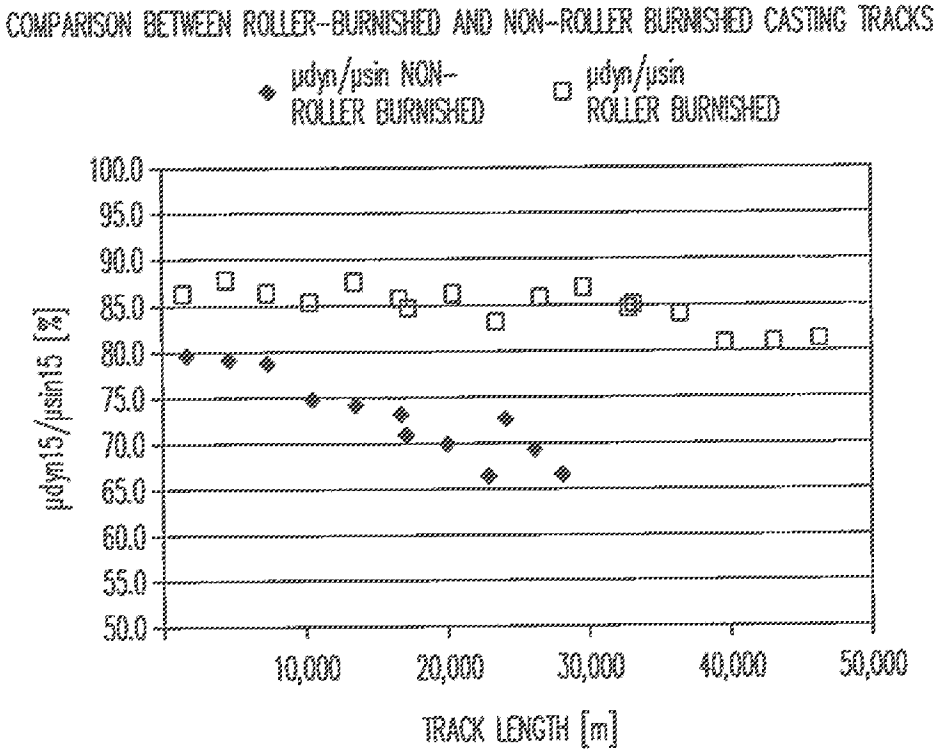
FIG. 12 is a graph that compares the $m_{dyn}/m_{sin}$ ratios at H=15 mA for a strip cast on a roller-burnished casting track and a casting track which has not been roller-burnished as a function of track length.
Figure 13:
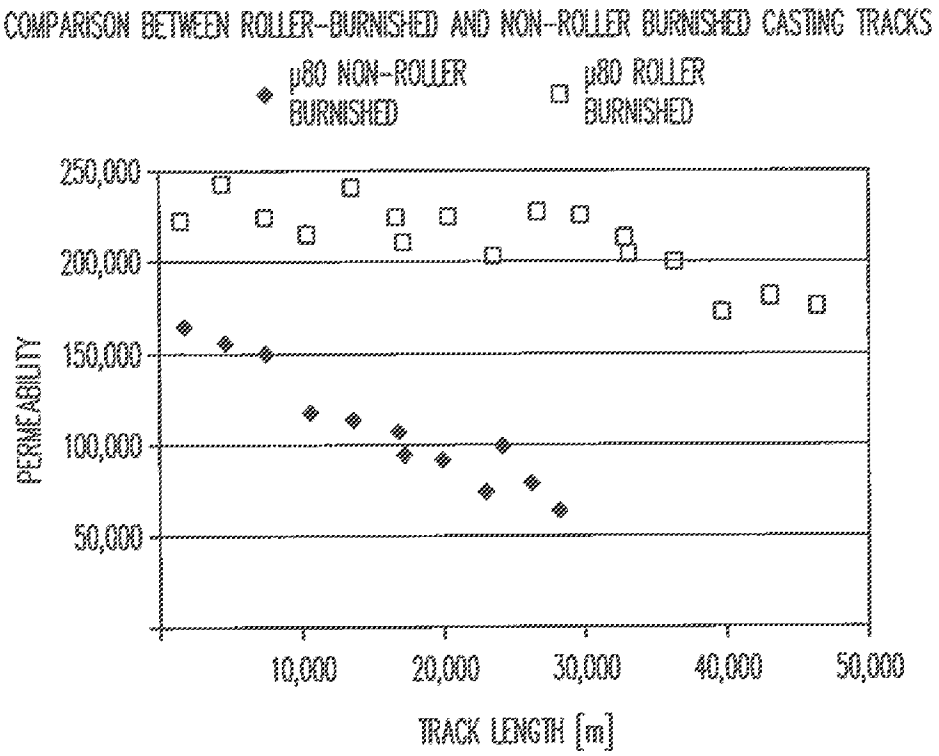
FIG. 13 is a graph that compares the normalised permeability $m_{80}$ for these strips.

FIG. 12 compares the $m_{dyn}/m_{sin}$ ratios at H=15 mA/cm for a strip cast on a roller-burnished casting track and a casting track which has not been roller-burnished, and FIG. 13 compares the normalised permeability $m_{80}$ for these strips. Both values are reduced more for a strip cast on a casting track which has not been roller-burnished than for a strip cast on a roller-burnished casting track.

On the basis of the results of the first experiments, it seems possible to achieve with this method and this alloy reliably and repeatably, at permeability values of $m_{sin}$>200 000, a $m_{dyn}/m_{sin}$ ratio>0.80, possibly even>0.85.

On the basis of various geometrical variables ($R_a$, $R_z$ and fill factor) and magnetic variables ($m_{sin}$, $m_{dyn}$ and the $m_{dyn}/m_{sin}$ ratio), it can be shown that the uniformity of product quality and the efficiency of the production method can be improved by the continuous working of the heat sink surface during the casting process.

The invention having been described herein with respect to certain of its specific embodiments and examples, it will be understood that these do not limit the scope of the appended claims.

The invention claimed is:

1. A method for production of a metallic strip using a rapid solidification technology, comprising:

providing a melt, providing a heat sink with an external surface, pouring the melt onto the external surface of the heat sink while the heat sink is moving, the melt solidifying on the external surface to form a strip, and pressing a rolling device against the external surface of the heat sink while the heat sink is moving, wherein the rolling device is a rotatable burnishing roller, the rotatable burnishing roller continuously contacting the external surface of the heat sink while the melt is poured onto the external surface, which smooths by burnishing the external surface of the heat sink.

2. The method according to claim 1, wherein the pressing of the rolling device against the external surface of the heat sink is continuous while the melt is poured onto the external surface of the heat sink.

3. The method according to claim 1, wherein the pressing of the rolling device against the external surface of the heat sink continuously reduces a roughness of the external surface of the heat sink while the melt is poured onto the external surface of the heat sink.

4. The method according to claim 1, wherein the pressing of the rolling device against the external surface of the heat sink also occurs before the melt is poured onto the external surface of the heat sink.

5. The method according to claim 1, wherein the rotatable burnishing roller is pressed against the external surface of the heat sink with a pressure sufficient to work the external surface of the heat sink while the heat sink is moving.

6. The method according to claim 1, wherein the rotatable roller is driven in a first direction of rotation and the heat sink is driven in a second direction of rotation while moving, the first direction of rotation being opposed to the second direction of rotation.

7. The method according to claim 1, further comprising moving the rolling device across the external surface of the heat sink parallel to the axis of rotation of the heat sink, so that the external surface of the heat sink is contacted spirally.

8. The method according to claim 1, wherein the strip is solidified and further comprising taking up the solidified strip continuously on a reel.

9. The method according to claim 1 wherein the melt comprises:

$T_aM_b$, wherein 70 atomic %≤a≤85 atomic % and 15 atomic %≤b≤30 atomic %, T being one or more of the elements Fe, Co, Ni, Mn, Cu, Nb, Mo, Cr, Zn, Sn and Zr, and M being one or more of the elements B, Si, C and P, or from $Fe_aCu_bM_cM'_dM''_eSi_fB_g$, M being one or more of the elements from the group of the IVa, Va, VIa elements or the transition metals, M' being one or more of the elements Mn, Al, Ge and the platinum elements, and M" being Co and/or Ni, wherein $a+b+c+d+e+f+g=100$ atomic % and $0.01 \leq b \leq 8$, $0.01 \leq c \leq 10$, $0 \leq d \leq 10$, $0 \leq e \leq 20$, $10 \leq f \leq 25$, $3 \leq g \leq 12$ and $17 \leq f+g \leq 30$.

* * * * *